US005146731A

United States Patent [19]

Marshall et al.

[11] Patent Number: 5,146,731

[45] Date of Patent: Sep. 15, 1992

[54] BAGGER RECEIVER BOX

[75] Inventors: Dale E. Marshall, Haslett; Galen K. Brown, Okemos; Richard J. Wolthuis, Haslett, all of Mich.

[73] Assignee: The United States of America as represented by the Secretary of Agriculture, Washington, D.C.

[21] Appl. No.: 801,157

[22] Filed: Dec. 2, 1991

Related U.S. Application Data

[63] Continuation-in-part of Ser. No. 540,982, Jun. 20, 1990, Pat. No. 5,095,686.

[51] Int. Cl.[5] ..... B65B 7/02; B65B 43/42

[52] U.S. Cl. ..... 53/469; 53/480; 53/284.7; 53/571; 53/374.3; 53/375.4; 198/476.1

[58] Field of Search ..... 53/469, 479, 480, 570, 53/571, 573, 284.7, 374.3, 374.8, 375.6, 390, 373.2, 375.4; 193/7, 16; 198/346.2, 476.1, 477.1, 860.4

[56] References Cited

U.S. PATENT DOCUMENTS

| | | | |
|---|---|---|---|
| 3,270,485 | 9/1966 | Knepper | 53/390 X |
| 3,407,567 | 10/1968 | Hudson | 53/573 X |
| 3,699,741 | 10/1972 | Norman | 53/284.7 X |
| 4,198,800 | 4/1980 | Wilson | 53/573 X |
| 4,510,733 | 4/1985 | Hansen et al. | 53/480 X |
| 4,649,696 | 3/1987 | Brie et al. | 53/479 |
| 4,706,441 | 11/1987 | Chervalier | 53/284.7 X |
| 5,095,686 | 3/1992 | Marshall et al. | 53/571 |

*Primary Examiner*—Horace M. Culver
*Attorney, Agent, or Firm*—M. Howard Silverstein; Randall E. Deck; John D. Fado

[57] ABSTRACT

An apparatus for bagging produce or other articles susceptible to damage upon impact. The apparatus includes a bag receiver and transfer assembly adapted to receive, hold upright, and gently transfer an open topped bag of articles, such as from an automatic bagger, to a bag closer and optional conveyor.

16 Claims, 5 Drawing Sheets

BAGGER RECEIVER BOX

BACKGROUND OF THE INVENTION

Related Applications

This application is a continuation-in-part of U.S. patent application Ser. No. 07/540,982 of Marshall et al., filed Jun. 20, 1990 and now U.S. Pat. No. 5,095,686.

Field of Invention

This invention relates to an apparatus for the bagging or packaging of produce or other articles susceptible to damage upon impact.

Description of the Prior Art

Conventional produce bagging devices subject the produce to bruising and damage as a result of being dumped into bags or other packages. Devices currently in use employ a pan into which the produce is temporarily placed, and an inclined bag support onto which the bags are laid, positioned below the pan outlet. By tipping the pan, the produce is effectively dumped into a bag on the support, with produce falling as much as 50 cm into an empty bag. Considerable bruising results in fruits or vegetables when the energy of the falling articles is absorbed on impact with hard surfaces or other articles already in the bag. After the produce is in the open topped bag, the filled bags are prone to tipping and spilling, particularly when they are transferred to a bag closing station. Because bagged produce is generally sold on a weight or count basis, if the produce is spilled the underfilled bag could be inadvertently shipped and illegally sold.

SUMMARY OF THE INVENTION

We have now invented an apparatus for bagging produce or other articles susceptible to damage upon impact. The apparatus includes a bag receiver and transfer assembly adapted to receive, hold upright, and gently transfer ana open topped bag of articles, such as from an automatic bagger, to a bag closer and optional conveyor.

When employed in combination with such an automated bagger, a bag positioning assembly opens a single bag and holds the same in an open position on a support, while the produce or articles are dispensed into an open bag on the support by a bag filling assembly. Once a bag is filled, the bag transfer assembly transports the filled bag from the support to a bag closing assembly, after which the bag may be discharged.

The primary object of the invention is to provide an apparatus for bagging produce or other articles which minimizes the impact received by the articles as they are put into bags and/or transferred to a bag closer or conveyor and prevents spillage of the filled bag prior to closing.

Another object of this invention is to provide a bag receiver and transfer assembly which may be used in conjunction with other produce bagging devices conventional in the art for automated or semi-automated bagging of produce or other articles susceptible to damage upon impact.

Other objectives and advantages of the invention will become readily apparent from the ensuing description.

DETAILED DESCRIPTION OF THE INVENTION

In accordance with this invention we have designed an apparatus for the automated or semi-automated bagging of produce or other articles susceptible to damage upon impact. While not being limited thereto, the device is especially suited to bagging fruits and vegetables, such as apples, onions, oranges, peaches, peppers, etc.

Figure 1:
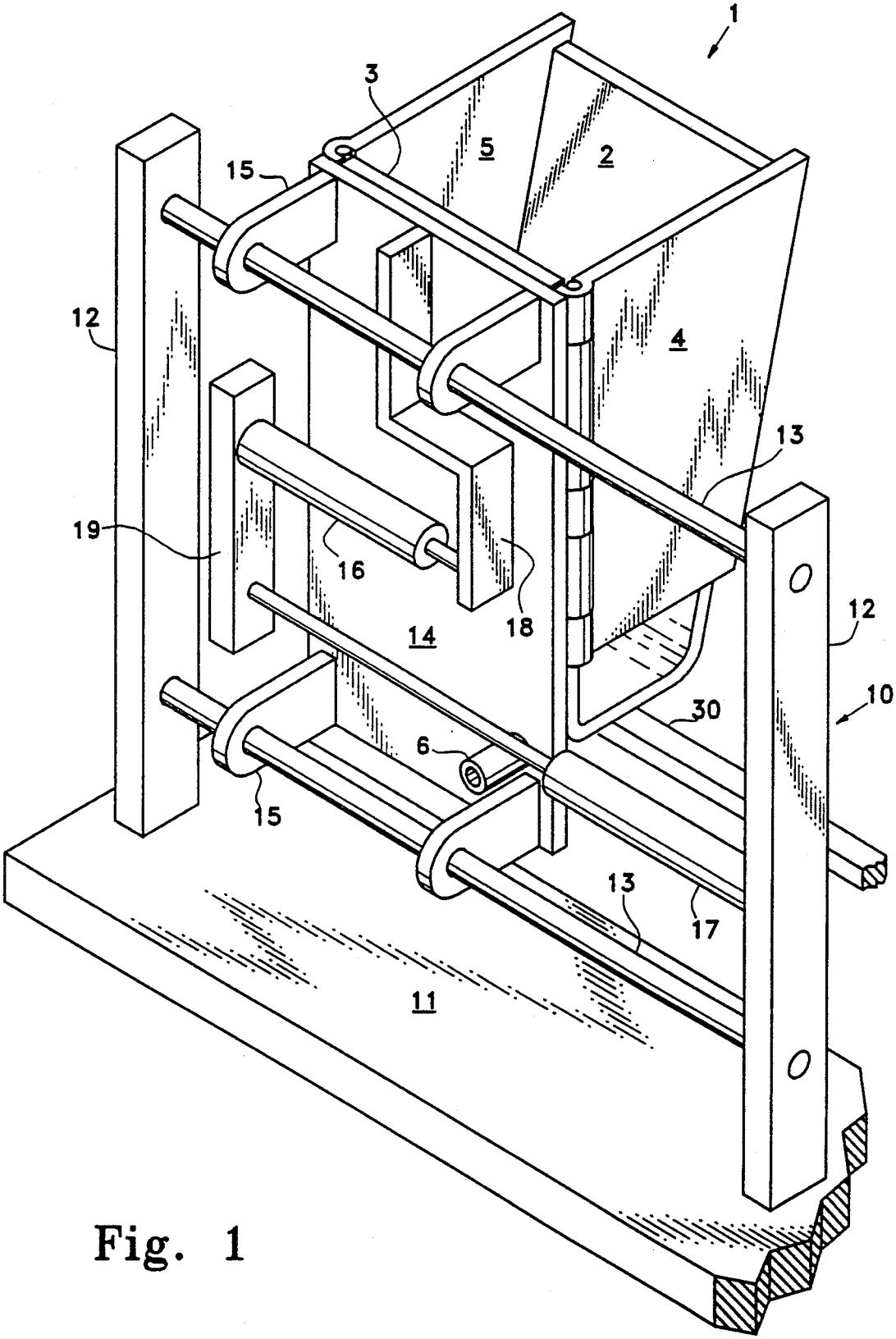
FIG. 1 is a perspective view from the back side of the apparatus showing the enclosure with assemblies for moving as well as tilting the enclosure.

Referring now to FIG. 1, the preferred embodiment for the bagger receiver box and transfer apparatus is shown for receiving a bag filled with produce or other articles, transferring the filled bag to a bag closer, and discharging the closed bag for shipment or further packaging. The apparatus includes an enclosure 1, having a closed bottom, opposed upwardly extending front and rear walls 2 and 3, opposed first and second operable and closable side walls or doors 4 and 5, respectively, and an open top. The first and second side walls may be pivotally attached to either of the front and rear walls, such as by a hinge or spring-aided hinge. The enclosure is tiltable about a horizontal axis through a plane including the rear wall, such as at enclosure pivot 6.

Figure 4A:
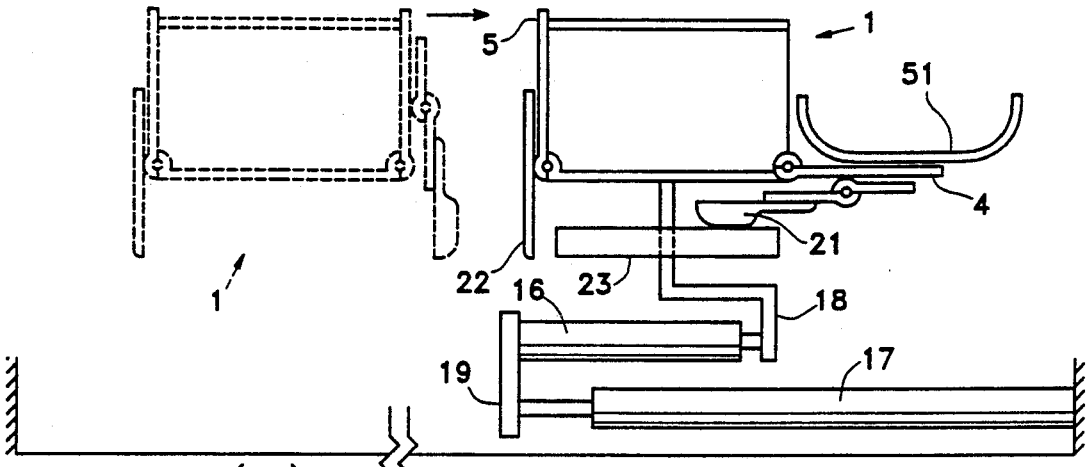
FIGS. 4(*a*), 4(*b*) and 4(*c*) are top views of the apparatus showing the sequential operations of the enclosure moving to receive a bag, receiving the bag, and discharging the bag.
Figure 4B:
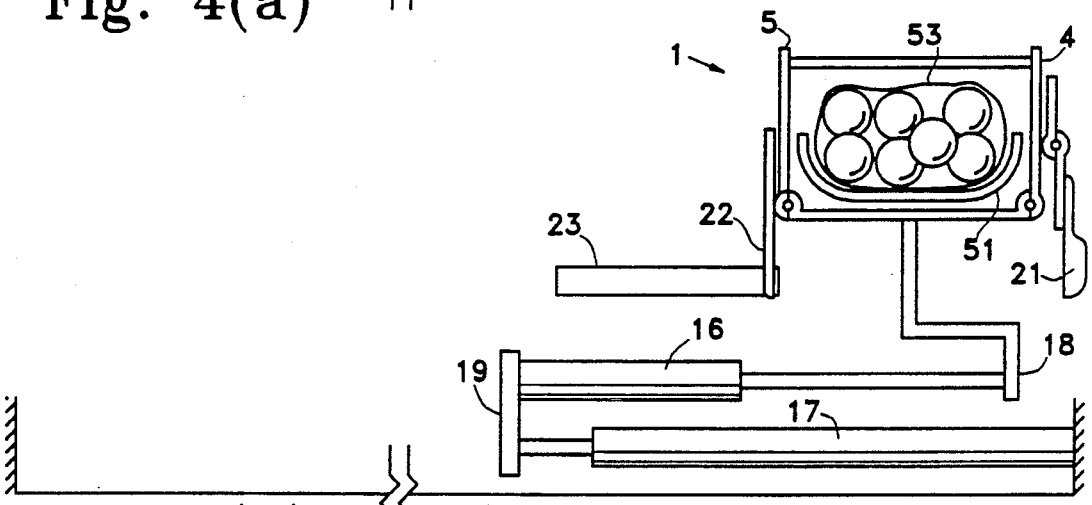
Figure 4C:
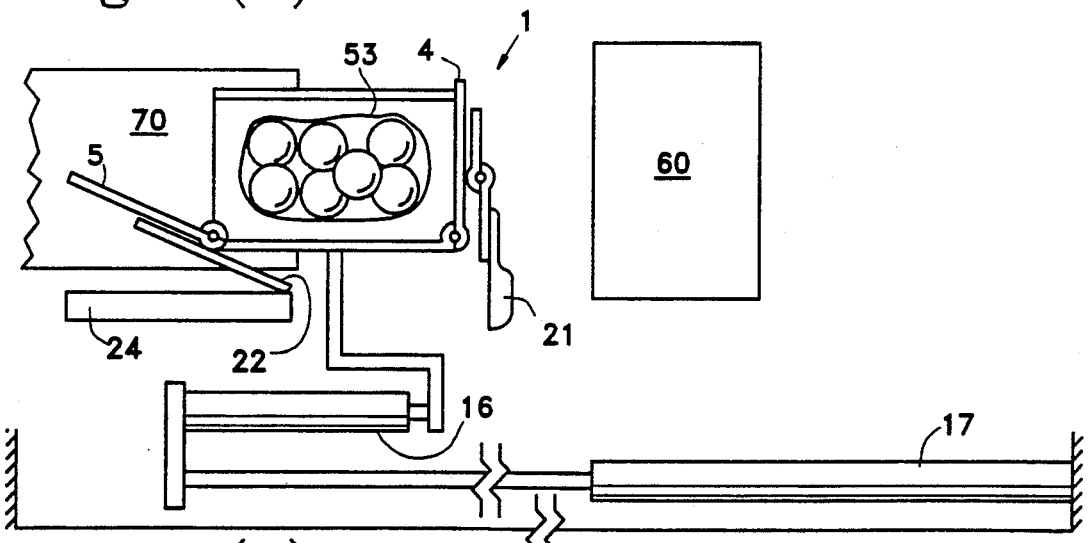

An assembly for mounting and moving of the enclosure in an approximately lateral or horizontal direction, perpendicular to the first and second side walls 4 and 5, is also provided, effective for transferring the enclosure between bag receiving, bag closing and bag discharge stations. As shown in the embodiment of FIGS. 1 and 4, mounting is accomplished by use of a frame 10 having a base 11, upright supports 12, and one or more horizontal guide rods 13. A support member or plate 14, onto which the rear wall 3 of the enclosure is pivotally attached at pivot 6, is slidably connected to the guide rods 13 by brackets 15, and connects the enclosure to the mounting and moving assembly. Movement of the enclosure along the guide rods 13 may be effected by first and second extensible/retractable reciprocating elements 16 and 17, respectively, such as pneumatic or hydraulic cylinders. The first reciprocating element 16 is attached at one end to the support member 14 (through brace 18), and at its opposite end to one end of the second reciprocating element 17 by connecting member 19. At its opposite end, the second reciprocating element 17 is attached to one of the upright supports 12. In FIG. 4, the size and orientation of the brace 18 and connecting member 19 are exaggerated to more clearly show the operation of the mounting and moving assembly as will be described in more detail hereinbelow.

The practitioner skilled in the art will recognize that other conventional elements could be employed as the mounting and moving assembly in the alternative to the reciprocating elements and/or frame. For example, a single variable stroke reciprocating element, attached at its ends to the mounting member 14 and an upright support 12, could be substituted for the pair of reciprocating elements 16 and 17. Other alternatives to the reciprocating elements include, but are not limited to ball screws, ropes and pulleys, or motors with cooperating gears. Similarly, it is understood that alternatives for mounting the enclosure may be employed, such as replacing the frame 10 and support member 14 in their entirety with one or more tracks, (e.g., track 30 described hereinbelow), to which the enclosure may be slidably attached at its bottom or front or rear walls. In accordance with this alternative embodiment, the same assembly would perform all of the functions of mounting, moving and tilting the enclosure (also described hereinbelow).

Figure 2:
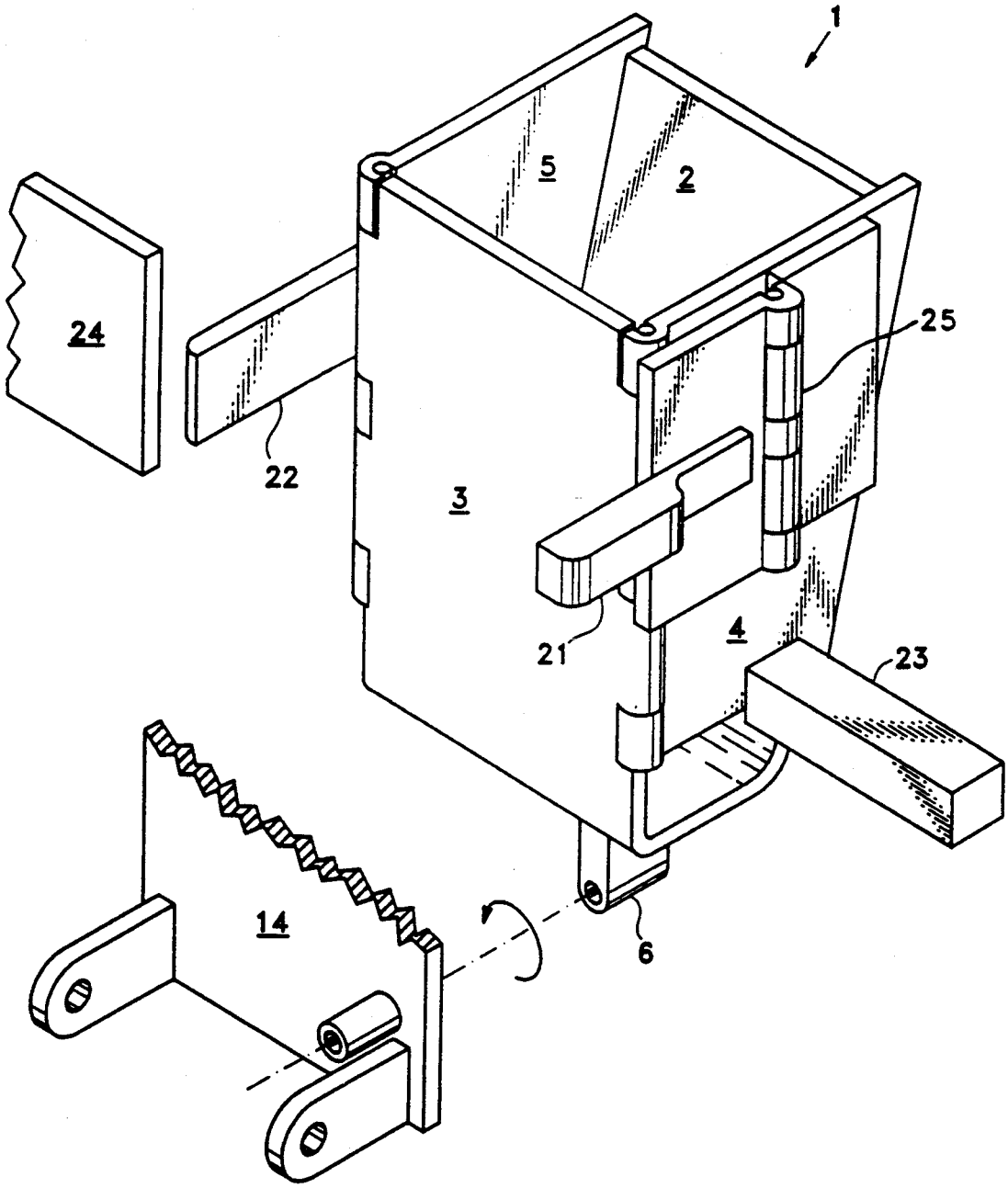
FIG. 2 is a perspective view from the back side of the bagger receiver box showing the enclosure with hinged side walls and an assembly for independently opening and closing the same.

Elements for independently opening and closing the side walls 4 and 5 are provided, enabling the opening of the side walls to receive and securely hold the filled bag within the enclosure, and subsequently discharge the closed bag therefrom. As shown in FIGS. 2 and 4, projections or cam followers 21 and 22 are connected to the side walls 4 and 5, respectively. Each projection extends beyond the rear wall 3 and is effective for engaging one of the first and second stops or cams 23 and 24, respectively, positioned adjacent the path of travel of the enclosure. As the enclosure moves toward and past one of the stops, the stop will engage a projection, forcing the respective side wall open. To more securely hold the filled bag and prevent inadvertent tipping thereof, the element for opening and closing the first side wall 4 is preferably adapted or constructed to allow the first side wall to close as soon as the bag is received in the enclosure, and before it is transferred. As particularly shown in FIGS. 4(*a*) and (*b*), the projection 21 is attached to a hinge 25 on the first side wall, and the stop 23 is selected with a length effective to disengage the projection 21 as soon as the bag is received within the enclosure. The hinge 25 allows the enclosure to subsequently move in the reverse direction [toward the position shown in FIG. 4(*c*)] without being impeded when projection 21 contacts the opposite end of stop 23.

In the alternative to projections and cooperating stops, the practitioner skilled in the art will recognize that other elements may be provided for opening and closing the side walls. Such alternatives may include, but are not limited to, automatically controlled motors or cranks.

Figure 3:
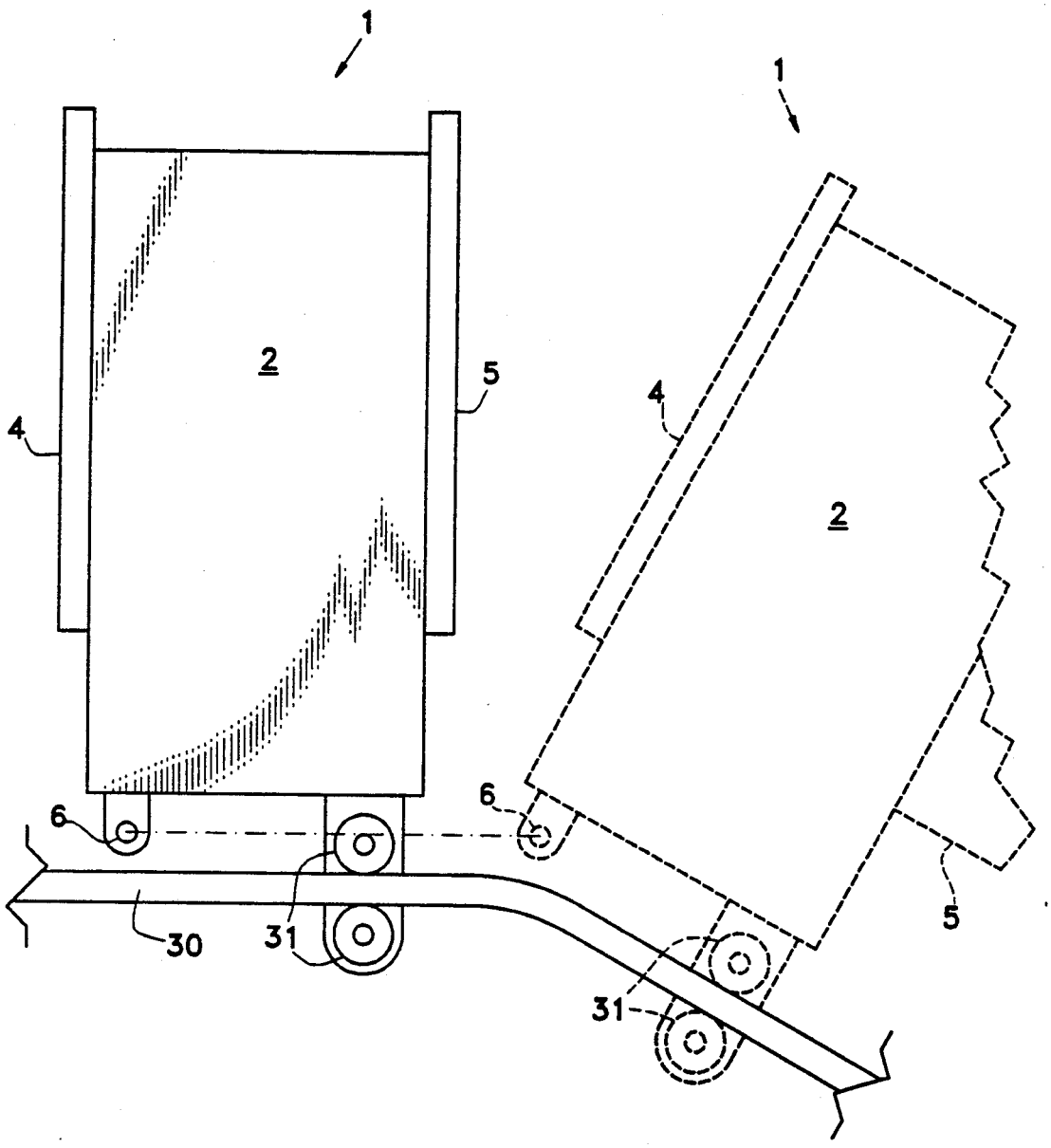
FIG. 3 is a front side view of the bagger receiving box as it is tilted from an upright position to a discharge position.

To discharge the filled bag from the enclosure after the bag is received and closed, an assembly is provided for tilting the enclosure about a horizontal axis to an extent that the bag may be dispensed by gravity through the opened second side wall 5. In the preferred embodiment shown in FIG. 3, this tilting assembly may be composed of an approximately horizontal track 30 to which the enclosure is slidably engaged, and having a downwardly extending portion at the end thereof adjacent the second side wall 5. Movement of the enclosure along the track may be facilitated by rollers 31 or bearings mounted to the enclosure. Alternatives to the use of track 30 for tilting may also include, but are not limited to, automatically controlled motors or cranks, or pulleys operably connected to the enclosure.

Although operation of the apparatus may be subject to manual control, preferably of all or part of the apparatus, and particularly the mounting and moving assembly, may be responsive to an automatic controller 40 such as a computer controller as is conventional in the art. Contact switches may also be provided for effecting operation of any of the individual components of the apparatus.

Reduction of bruising and other damage to the produce or articles may also be reduced by providing padding material (not shown) on the interior surfaces of the enclosure. Suitable padding materials may be readily determined and include, but are not limited to carpeting, closed-cell foams, and Nomad (3-M, St. Paul, Minn.), an open-cell vinyl, extra-duty floor matting.

While the bagger receiver box and transfer apparatus of this invention may be employed in combination with produce bagging devices or components thereof conventional in the art, in the preferred embodiment the bagger receiver box and transfer apparatus is used in combination with the Produce Bagging Machine described by Marshall et al. [U.S. patent application Ser. No. 07/540,982, filed Jun. 20, 1990 and now U.S. Pat. No. 5,095,686], the contents of which are incorporated by reference herein. When used in this combination, the bagger receiver box and transfer apparatus replaces the second conveyor means of the produce bagging machine, and provides for improved receipt and transfer of the filled bags without spillage.

Figure 5:
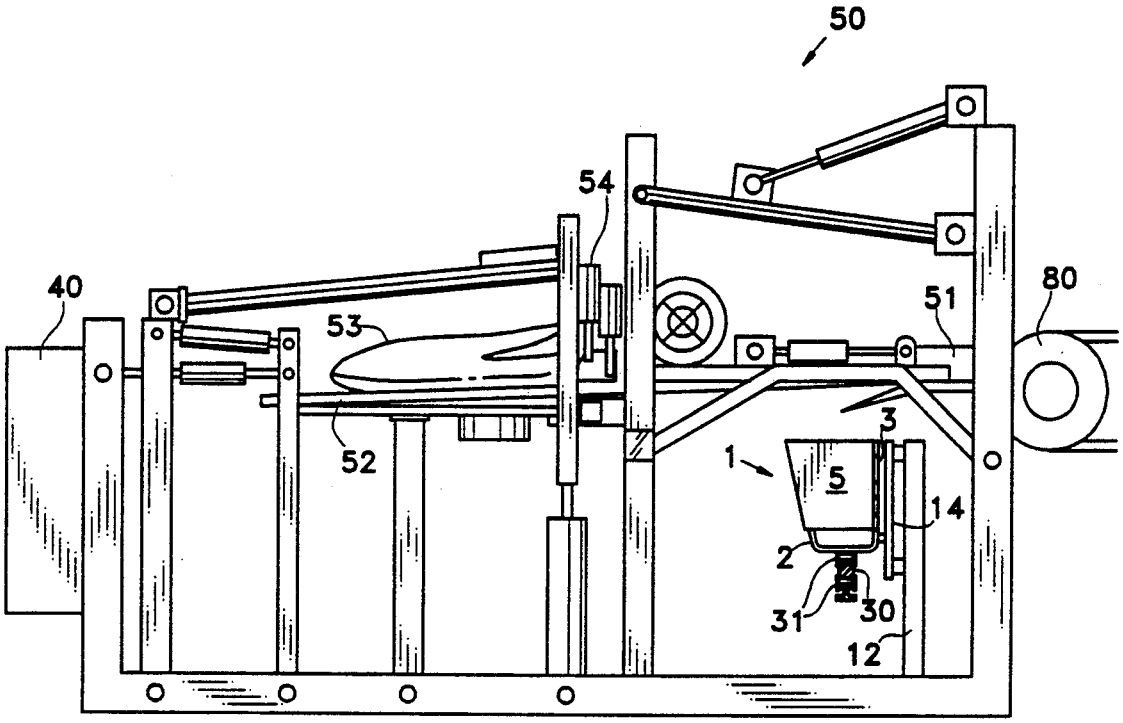
FIG. 5 is a side view of the apparatus in combination with an automated produce bagging machine.

As shown in FIG. 5, the produce bagging machine may include, but is not limited to, a bag filling station 50 including a tiltable support 51 for receiving and temporarily holding a quantity of articles while in an approximately horizontal position, and having an open end portion for discharging the articles when the support is tilted to a non-horizontal position. The apparatus may also include a bag holder assembly 52 to provide a supply of bags 53, and a bag positioning assembly 54 which functions to engage an empty bag and position its open end around or over the support 51 such that the support is at least partially inserted into the bag, and wherein the end portion of the support is near or adjacent to the closed end of the bag. The structures and operation of the produce bagging machine including the bag filling station and its components are described in Marshall, et al.

In addition to the produce bagging machine, a bag closing station 60, and/or a conveyor 70 [shown in FIG. 4(*c*)] may also be provided. Suitable bag closing devices are well known and may be readily selected from among those conventional in the art.

The practitioner skilled in the art will recognize that the bagger receiver box and transfer assembly may be used in combination with other conventional bagging machines such as those of Powell, Jr. (U.S. Pat. No. 4,177,621) or Sheetz et al. (U.S. Pat. No. 3,864,894), the content of which are herein incorporated by reference. Such bagging machines preferably include a bag filling station having a produce supply assembly and bag opening device, as well as a bag closing assembly.

METHOD OF OPERATION

Operation of the apparatus commences with the second reciprocating element 17 retracting, moving enclosure 1 in a direction toward the bag filling station. As the projection 21 contacts the first stop 23, the first side wall 4 opens, placing the enclosure at the start position [FIG. 4(*a*)]. While the enclosure moves to this start position, the bag positioning assembly 54 engages a bag from the bag holder assembly 52 and positions the bag over the tiltable support 51 as described hereinabove; The bag is securely held on the support by a releasable bag retaining device such as a clamp. At the approximate time that the bag is positioned over the support 51, a measured quantity of the articles to be bagged is delivered to the support manually or with an optional produce supply assembly 80 such as a conveyor or hopper. Subsequent tipping of the support permits the articles to settle toward the closed end of the bag.

After the bag is filled, the enclosure is moved to the position shown in FIG. 4(*b*) to receive the bag. Extension of the first reciprocating element 16, moves the enclosure around the bag and allows the stop 23 to disengage projection 21, closing the first side wall 4. The bag is then released from the support 51, and the support is raised and withdrawn from the bag, leaving the bag securely held within the enclosure. To further minimize impact to the bagged articles, the bagger receiver box and transfer apparatus is preferably positioned with the closed bottom of the enclosure 1 near the closed end of the bag on the tipped support. This positioning ensures that the filled bag does not drop a substantial distance from the support to the enclosure.

Once the support 51 is raised out of the enclosure 1, the first reciprocating element 16 retracts and the second reciprocating element 17 extends, transferring the enclosure and bag in the reverse direction to the bag closing assembly 60 for applying a closure or otherwise sealing the bag. As the enclosure continues to move further in this reverse direction to the position shown in FIG. 4(*c*), projection 22 engages stop 24, opening the second side wall 5. At approximately the same time, the enclosure is tilted by about 30 to 45 degrees (FIG. 3), discharging the now closed bag onto conveyor 70 or other receiver.

It is understood that the foregoing detailed description is given merely by way of illustration and that modifications and variations may be made therein without departing from the spirit and scope of the invention.

We claim:

1. A bagger receiver box and transfer apparatus for receiving a bag filled with articles and transferring and discharging said bag comprising:

a. an enclosure having a closed bottom, opposed upwardly extending front and rear walls, opposed first and second openable and closable side walls extending between said front and rear walls, and an open top, said enclosure being tiltable about a horizontal axis through a plane including said rear wall;

b. means for independently opening and closing said first and second side walls;

c. means for mounting and moving said enclosure in an approximately horizontal direction perpendicular to said first and second side walls and said horizontal axis; and d. means for tilting said enclosure about said horizontal axis to an extent that a bag filled with articles and within said enclosure may be discharged by gravity through one of said side walls;

said apparatus being operable to receive a bag filled with articles at a bag filling station, transfer said filled bag to a bag closing station, and then discharging the closed bag.

2. An apparatus as described in claim 1 wherein each of said first and second openable and closable side walls are pivotally attached to said rear wall.

3. An apparatus as described in claim 2 wherein said means for opening and closing said first and second side walls include:

a. a projection attached to said first side wall and extending beyond said rear wall and operable to engage a first stop to open said first side wall as said enclosure moves in a direction toward said first side wall from said second side wall; and b. a projection attached to said second side wall and extending beyond said rear wall and operable to engage a second stop to open said second side wall as said enclosure moves in a direction toward said second side wall from said first side wall.

4. An apparatus as described in claim 1 wherein said means for tilting comprises a track slidably engaging said enclosure and having a downwardly extending end.

5. An apparatus as described in claim 1, further comprising automatic control means for controlling operation of said apparatus.

6. An apparatus for bagging produce or other articles comprising in combination:

a. a bag filling station effective for holding and filling a bag with said produce or articles; and b. a bagger receiver box and transfer apparatus for receiving a filled bag from said bag filling station, and transferring and discharging said filled bag comprising:

(1) an enclosure having a closed bottom, opposed upwardly extending front and rear walls, opposed first and second openable and closable side walls extending between said front and rear walls, and an open top, said enclosure being tiltable about a horizontal axis through a plane including said rear wall;

(2) means for independently opening and closing said first and second side walls;

(3) means for mounting and moving said enclosure in an approximately horizontal direction perpendicular to said first and second side walls and said horizontal axis; and (4) means for tilting said enclosure about said horizontal axis to an extent that a bag filled with articles and within said enclosure may be discharged by gravity through one of said side walls;

said apparatus being operable to receive a bag filled with articles at said bag filling station, transfer said filled bag to a bag closing station, and then discharging the closed bag.

7. An apparatus as described in claim 6 wherein each of said first and second openable and closable side walls are pivotally attached to said rear wall.

8. An apparatus as described in claim 7 wherein said means for opening and closing said first and second side walls include:

a. a projection attached to said first side wall and extending beyond said rear wall and operable to engage a first stop to open said first side wall as said enclosure moves in a direction toward said first side wall from said second side wall; and b. a projection attached to said second side wall and extending beyond said rear wall and operable to engage a second stop to open said second side wall as said enclosure moves in a direction toward said second side wall from said first side wall.

9. An apparatus as described in claim 6 wherein said means for tilting comprises a track slidably engaging said enclosure and having a downwardly extending end.

10. An apparatus as described in claim 6, further comprising automatic control means for controlling operation of said bagger receiver box and transfer apparatus.

11. An apparatus as described in claim 6 further comprising automatic control means for controlling operation of said apparatus for bagging produce or other articles.

12. An apparatus as described in claim 6 further comprising a bag closing assembly for closing a filled bag in said enclosure.

13. An apparatus as described in claim 6 wherein said bag filling station includes a tiltable support for receiving and temporarily holding a quantity of produce or articles while in an approximately horizontal position, and having an open end portion for discharging the articles when the support is tilted to a non-horizontal position.

14. An apparatus as described in claim 6 further comprising a bag holder assembly for providing a supply of empty bags.

15. An apparatus as described in claim 14 further comprising a bag positioning assembly for engaging one of said empty bags from said bag holder assembly and transferring said empty bag to said bag filling station.

16. A method for bagging produce or other articles comprising:

a. providing a bag filling station effective for holding and filling a bag with said produce or articles;

b. dispensing said produce or articles into a bag at said bag filling station;

c. providing a bagger receiver box and transfer apparatus for receiving a filled bag from said bag filling station, and transferring and discharging said filled bag comprising:

(1) an enclosure having a closed bottom, opposed upwardly extending front and rear walls, opposed first and second openable and closable side walls extending between said front and rear walls, and an open top, said enclosure being tiltable about a horizontal axis through a plane including said rear wall;

(2) means for independently opening and closing said first and second side walls;

(3) means for mounting and moving said enclosure in an approximately horizontal direction perpendicular to said first and second side walls and said horizontal axis; and (4) means for tilting said enclosure about said horizontal axis to an extent that a bag filled with articles and within said enclosure may be discharged by gravity through one of said side walls;

said apparatus being operable to receive a bag filled with articles at said bag filling station, transfer said filled bag to a bag closing station, and then discharging the closed bag, d. receiving said filled bag in said enclosure;

e. closing said filled bag at said bag closing station; and f. discharging the closed bag from said enclosure.

* * * * *